US006896483B2

(12) United States Patent
Dierksmeier et al.

(10) Patent No.: US 6,896,483 B2
(45) Date of Patent: May 24, 2005

(54) BLADE TRACK ASSEMBLY

(75) Inventors: Douglas D. Dierksmeier, Franklin, IN (US); Tab Michael Heffernan, Plainfield, IN (US); James C. Muskat, Mooresville, IN (US)

(73) Assignee: Allison Advanced Development Company, Indianapolis, IN (US)

( * ) Notice: Subject to any disclaimer, the term of this patent is extended or adjusted under 35 U.S.C. 154(b) by 305 days.

(21) Appl. No.: 10/189,121

(22) Filed: Jul. 2, 2002

(65) Prior Publication Data

US 2003/0049121 A1 Mar. 13, 2003

Related U.S. Application Data

(60) Provisional application No. 60/302,463, filed on Jul. 2, 2001.

(51) Int. Cl.[7] ..... F01D 11/18

(52) U.S. Cl. ..... 415/138; 415/137; 415/173.3; 403/28; 403/29; 403/30

(58) Field of Search ..... 415/134–136, 415/138, 139, 173.1, 173.2, 173.3, 175–178; 403/28–30; 248/314–315

(56) References Cited

U.S. PATENT DOCUMENTS

| | | | | |
|---|---|---|---|---|
| 2,710,523 A | * | 6/1955 | Purvis | 415/134 |
| 3,841,787 A | | 10/1974 | Scalzo | |
| 3,860,358 A | | 1/1975 | Cavicchi et al. | |
| 4,314,792 A | | 2/1982 | Chaplin | |
| 4,463,638 A | | 8/1984 | Fortin | |
| 4,502,809 A | * | 3/1985 | Geary | 403/28 |
| 4,762,462 A | * | 8/1988 | Lardellier | 415/177 |
| 5,092,735 A | | 3/1992 | Katy et al. | |
| 5,098,257 A | | 3/1992 | Hultgren et al. | |
| 5,127,793 A | | 7/1992 | Walker et al. | |
| 5,145,316 A | | 9/1992 | Birch | |
| 5,161,944 A | | 11/1992 | Wood | |
| 5,197,281 A | | 3/1993 | Przytulski et al. | |
| 5,238,364 A | | 8/1993 | Kreitmeier | |
| 5,290,144 A | | 3/1994 | Kreitmeier | |
| 5,295,787 A | | 3/1994 | Leonard et al. | |
| 5,299,910 A | | 4/1994 | Gilchrist | |
| 5,332,358 A | | 7/1994 | Hemmelgarn et al. | |
| 5,593,276 A | * | 1/1997 | Proctor et al. | 415/173.1 |
| 5,609,469 A | | 3/1997 | Worley et al. | |
| 5,630,702 A | * | 5/1997 | Marmilic et al. | 415/173.1 |
| 5,693,210 A | | 12/1997 | Tomita et al. | |
| 5,785,492 A | | 7/1998 | Belsom et al. | |
| 5,833,244 A | | 11/1998 | Salt et al. | |
| 5,871,333 A | | 2/1999 | Halsey | |
| 6,062,813 A | | 5/2000 | Halliwell et al. | |
| 6,082,961 A | | 7/2000 | Anderson et al. | |

FOREIGN PATENT DOCUMENTS

| | | | | |
|---|---|---|---|---|
| GB | 869908 A | * | 6/1961 | 415/136 |
| GB | 1363897 A | * | 8/1974 | 415/136 |
| JP | 58-206806 A | * | 12/1983 | 415/173.3 |
| JP | 2-298604 A | * | 12/1990 | 415/173.3 |
| JP | 5-288080 A | * | 11/1993 | 415/173.1 |

* cited by examiner

*Primary Examiner*—Christopher Verdier
(74) *Attorney, Agent, or Firm*—Woodard, Emhardt, Moriarty, McNett & Henry LLP

(57) ABSTRACT

The clearances between an array of turbine blades and its surrounding blade track may be controlled by an expansion control material system supporting the blade tracks. The blade track support hoop is placed in tension by the expansion control material placed therein and the expansion control material is placed in compression.

21 Claims, 5 Drawing Sheets

BLADE TRACK ASSEMBLY

RELATED APPLICATIONS

The present application claims the benefit of U.S. Provisional Application Ser. No. 60/302,463, filed Jul. 2, 2001, which is incorporated herein by reference.

GOVERNMENT RIGHTS

The present invention was developed under United States Air Force Contract No. F33615-97-C-2778, and the United States Air Force has certain rights therein.

BACKGROUND OF THE INVENTION

The present invention relates generally to blade tracks for gas turbine engines. More specifically, the present invention relates to a blade track support assembly having controlled thermal expansion properties.

A gas turbine engine is typical of the type of machinery which the invention described herein may be advantageously employed. It is well known that a gas turbine engine conventionally comprises a compressor for compressing inlet air to an increased pressure for combustion in a combustion chamber. A mixture of fuel and the increased pressure air is burned in the combustion chamber to generate a high temperature gaseous flow-stream for causing rotation of turbine blades within the engine. In an effort to reduce specific fuel consumption of engines, there has been a move to increase the efficiency of the turbine by decreasing the clearance between the rotating turbine blade tips and the stationary blade track. In designing a gas turbine engine with tighter blade tip clearances, designers must account for transient conditions that the gas turbine engine experiences during operation. During acceleration of the gas turbine engine, the rotor carrying the turbine blades experiences mechanical growth in a radial direction faster than blade track/shroud, thereby allowing the potential for mechanical contact between the blade tips and the blade track/shroud. During deceleration of the gas turbine engine, the blade track/shroud exhibits mechanical shrinkage in the radial direction more quickly than the rotor, thereby allowing the potential for mechanical contact between the blade tips and the blade track/shroud.

The present invention seeks to control the clearance between the blade tips and the blade track/shroud by lowering the thermal expansion of the blade track support assembly, thereby allowing a reduction in the steady state run clearance between the blade tip and the blade track/shroud. The resulting improvement is manifested as an increase in turbine efficiency and a reduction in specific fuel consumption. The present invention provides a novel and non-obvious blade track/shroud assembly for a gas turbine engine.

SUMMARY OF THE INVENTION

One form of the present invention contemplates a support for a gas turbine engine blade track, comprising: a ring member having a centerline, the ring member having a cavity open towards the centerline; a plurality of circumferentially spaced ceramic members positioned within the cavity; and, a plurality of metallic members positioned within the cavity, the plurality of ceramic members and the plurality of metallic members are positioned so that each of the plurality of ceramic members is located between a pair of the plurality of metallic members.

Yet another form of the present invention contemplates a blade track support assembly, comprising: a continuous metallic ring member symmetrical about a centerline, the ring member having a circumferential channel opening towards the centerline; a plurality of circumferentially spaced ceramic cylinders extending parallel to the centerline and located within the channel, each of the ceramic cylinders has an outer surface; and, a plurality of circumferentially spaced metallic spacers extending parallel to the centerline and located within the channel, each of the plurality of metallic spacers including a pair of bearing surfaces corresponding to the outer surface, each of the plurality of ceramic cylinders located between a pair of the plurality of metallic spacers, and each of the bearing surfaces abutting one of the ceramic cylinders.

One object of the present invention is to provide a unique blade track support.

Further objects and advantages of the present invention will become apparent from the following description of the preferred embodiment.

DESCRIPTION OF THE PREFERRED EMBODIMENTS

Figure 1:
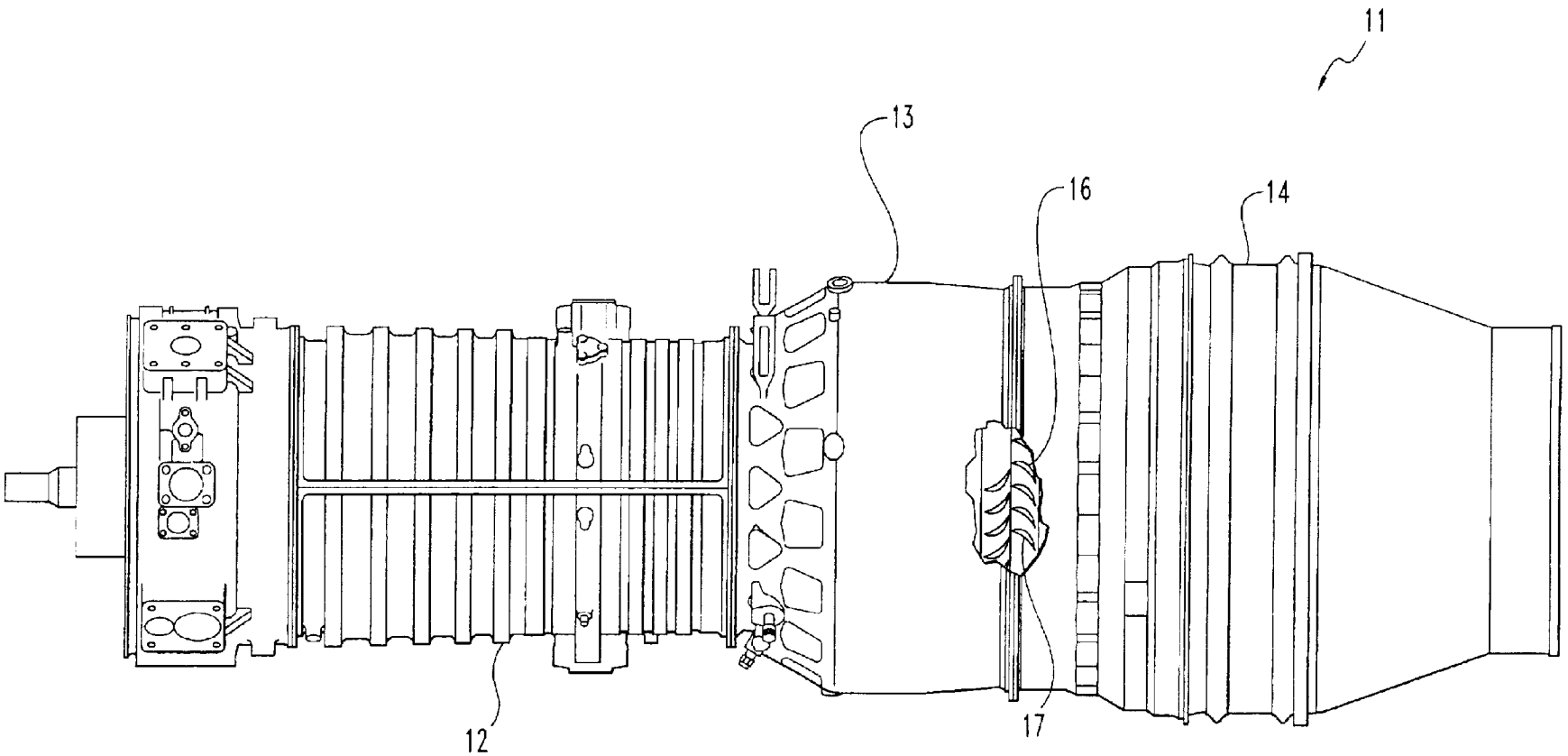
FIG. 1 is a partially fragmented side elevational view of a gas turbine engine.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is shown an exemplary gas turbine engine 11. It is understood that such power plants as gas turbine engine 11 may find application in all types of aircraft, including for example, helicopters, fixed wing planes, tactical fighters, trainers, missiles and other related apparatus. Further, the gas turbine engine may be equally suited to be used for a wide variety of industrial applications. Historically, there has been the widespread application of industrial gas turbine engines, such as pumping sets for gas and oil transmission lines, electricity generation and naval propulsion. The gas turbine engine 11 includes a compressor 12, a combustor 13 and a turbine 14. This is only an example of a gas turbine engine and it will be understood that there are a variety of ways that the components may be linked together or arranged. The gas turbine engine 11 includes a rotor disk 17, with a plurality of turbine blades 16 mounted thereto, that is coupled to a shaft (not shown) within gas turbine engine 11.

Figure 2:
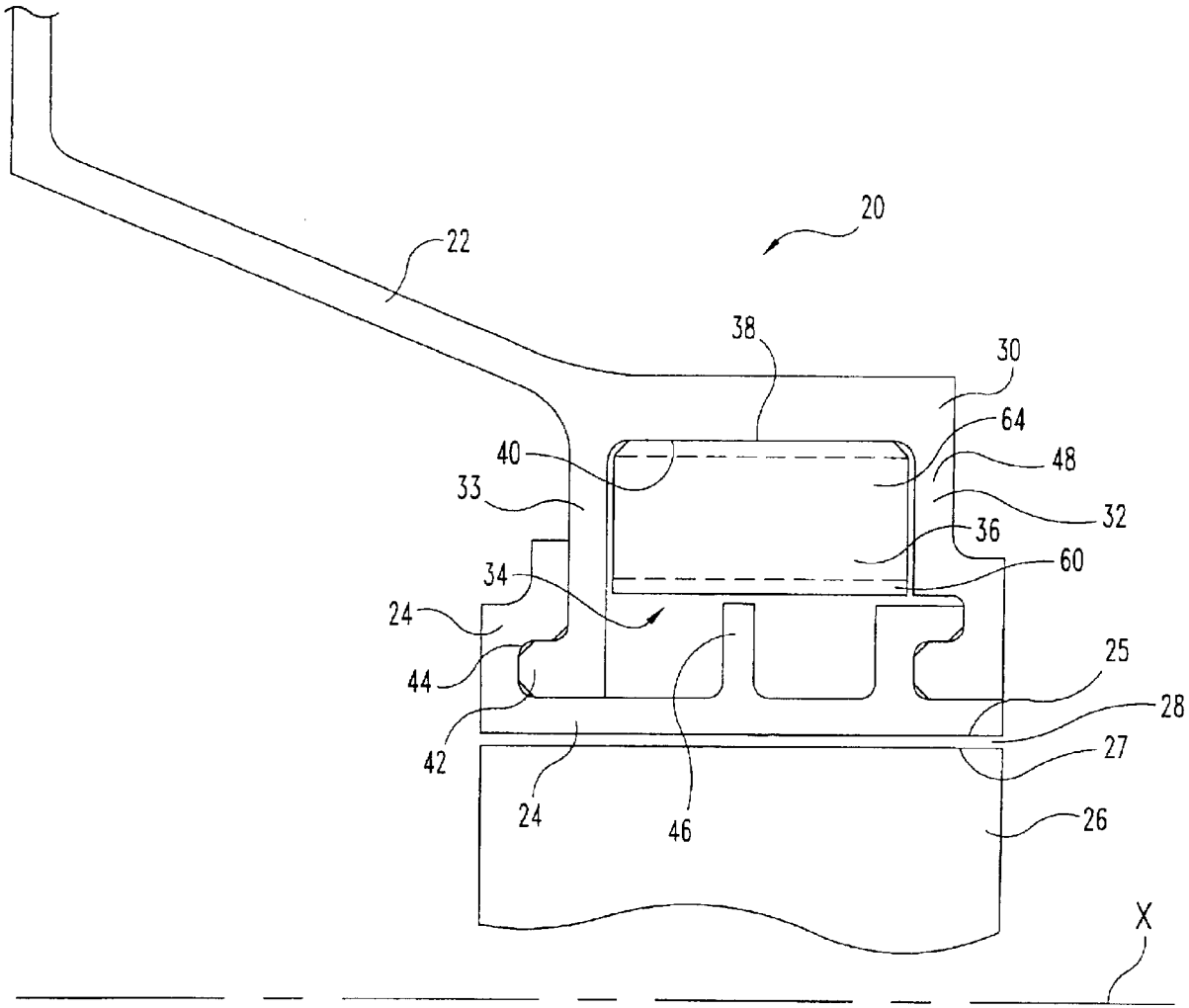
FIG. 2 is a side view of a portion of one embodiment of a blade track and support assembly that comprises a portion of the FIG. 2 gas turbine engine.
Figure 3:
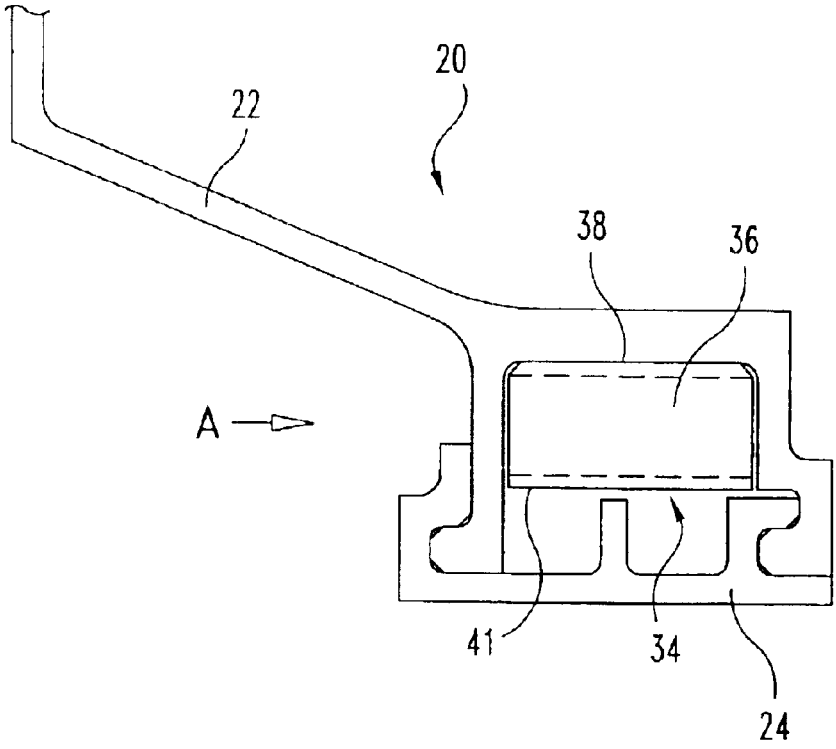
FIG. 3 is a view of the blade track and support assembly of FIG. 2 that has the gas turbine engine blade removed.

With reference to FIG. 2, there is illustrated a portion of the working fluid sealing system 20. In one form of the present invention, the sealing system 20 is designed to minimize the leakage of working fluid in the working fluid pathway in the turbine 14. However, it is contemplated herein that the working fluid sealing system could be utilized in other portions of the working fluid pathway within the gas turbine engine. Controlling the clearance 28 between the tips 27 of turbine blades 26 and surface 25 of the blade track 24 assists in minimizing the bypassing of the rotor 17 and turbine blades 16 by the working fluid. The present application will utilize the term blade track interchangeably with the term shroud and/or air seal.

In one form of the present invention, the sealing system 20 comprises two components that form a substantial seal between the rotating and static components. The term "seal" as utilized herein includes the reduction and/or the elimination of fluid flow between the rotating and static components. There is no intent herein to limit the term "seal" to a theoretical fluid tight seal. More specifically, the support structure for the stationary components comprises thermal expansion control features that are intended to control the movement of blade track inner surface 25. In a preferred embodiment, support 22 comprises a continuous hoop member 30 and an inner cavity 34. In one form the ring member that is symmetrical about a centerline X defines the continuous hoop member 30. Inner cavity 34 is bounded by inner surface 38 of continuous hoop member 30 and first sidewall 32 and second sidewall 33. However, other geometries for the ring member are contemplated herein.

Figure 4:
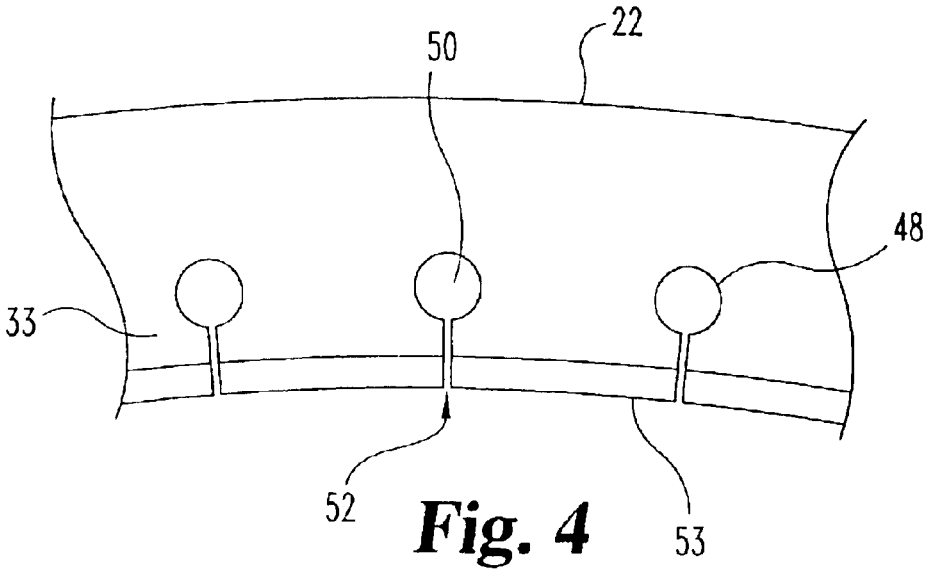
FIG. 4 is an enlarged view of the blade track support assembly of FIG. 3 from the direction of arrow A with the blade track segments removed.
Figure 5:
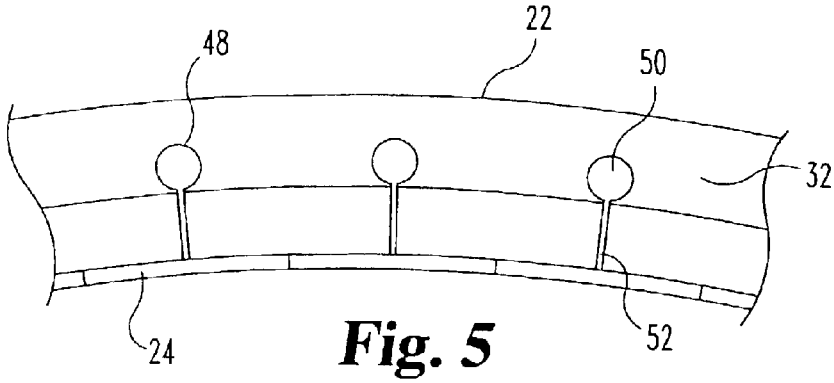
FIG. 5 is an enlarged end view of the blade track support assembly of FIG. 3.

With reference to FIGS. 4 and 5, there is illustrated one embodiment of the first and second side walls 32 and 33 which may be substantially interrupted at various intervals by circular holes 50 and slots 52 extending from the holes to inner edge 53 of support 22. It will be appreciated that slot 52 permits some movement of the adjacent walls to allow for expansion or contraction. Further, circular opening 50 permits material deformation that may accompany changes in the width of slot 52 to be spread over a greater area to limit stress concentrations. While the particular use of the combination of slots and circular openings are contemplated in a preferred embodiment, it will be appreciated that other side wall interruptions or configurations that allow for at least some expansion or contraction may be utilized with the present invention. In another form of the present invention, the sidewalls are continuous and have no interruption or slots cut therein.

An expansion control material 36 is disposed within inner cavity 34. Expansion control material 36 includes an outer surface 40 adapted to bear against inner surface 38 of continuous hoop 30. As discussed more fully below, expansion control material 36 may be maintained in position by engagement with inner surface 38 under a compressive load. Further sidewalls 32 and 33 inhibit forward and backward movement. Still further, once assembled, blade track 24 includes a finger member 46 adapted to limit inward buckling of the expansion control material. It is understood herein that blade track preferably includes a plurality of blade track segments. The finger member in one embodiment extends continuous along the assembled blade track and in an alternate embodiment is discontinuous.

Figure 6:
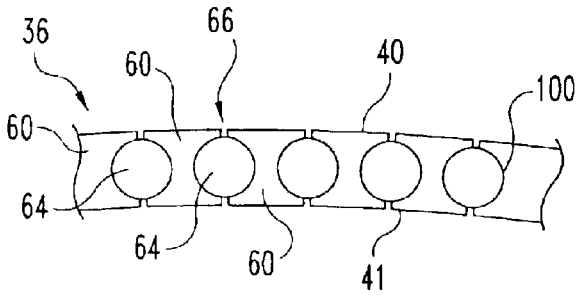
FIG. 6 is an illustrative view of the spacers and low expansion members comprising a portion of the blade track support assembly of the present invention.

In a preferred form of the invention, expansion control material 36 comprises multiple materials having different thermal expansion coefficients. Referring to FIGS. 2 and 6, there is illustrated a preferred form of the expansion control material 36 which comprises alternating ceramic members 64 and metallic spacers 60. The ceramic members 64 and the metallic spacers 60 are preferably elongated in the direction of the centerline X. It is preferred that the ceramic members 64 have a rounded outer surface to minimize point loading and more preferably are cylindrical in shape. In FIG. 2, the ceramic members 64 are shown in phantom lines and the metallic spacers 60 are shown in solid lines. While the combination of ceramic and metallic spacers is shown in the preferred embodiment, other materials may be utilized in accordance with the present invention to tailor the blade track expansion characteristics. Additionally, it is desired that the ceramic members 64 have a low thermal expansion coefficient such that the inner diameter of the support member and attached blade track remains substantially constant in diameter, or with only minor variations, over a wide range of operating conditions for the gas turbine engine. Ceramic members 64 preferably have a thermal expansion coefficient lower than the thermal expansion coefficient of the hoop 30 and the spacers 60. Further, the expansion control material may be selected to impart greater or lesser expansion forces on the support member to impart the desired blade tip clearances for various applications. Further, in one form of the present application, a plurality of spacers 60 has a first mode wherein they are separated, and a second mode wherein at least a pair of the plurality of spacers abut one another.

Figure 7:
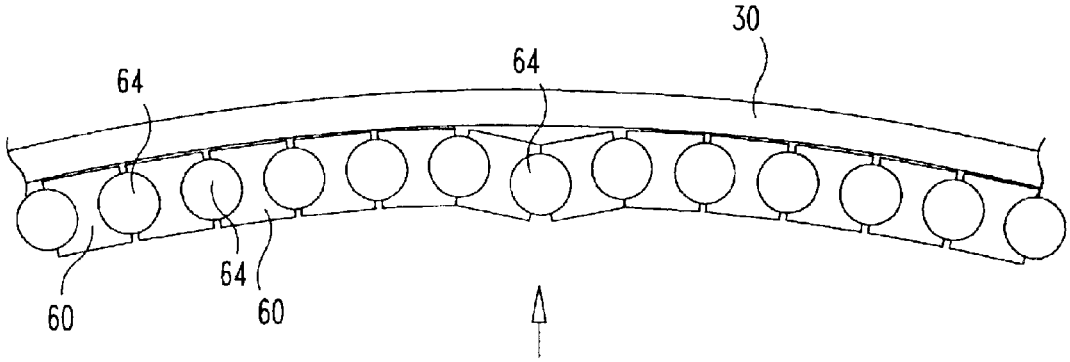
FIG. 7 is an illustrative end view of the spacers and low expansion members being assembled into the blade track support assembly with the sidewall removed for clarity.

The blade track assembly according to the present invention may be assembled in the following steps. The assembled fluid sealing system 20 has the ceramic members 64 disposed between metallic spacers 60 and loaded against the inner surface 38 within the cavity 34 of the hoop 30. A blade track support member with a continuous hoop is provided. Ceramic cylinders 64 and metallic spacers 60 are fitted into position within interior cavity 34 to engage one another and put support ring 30 in tension by pressing against surface 38. The cylinders 64 and spacers 60 would likewise be loaded in compression against the inner surface 38 of the hoop 30. During assembly, it is contemplated the last cylinder would be pressed into position. With reference to FIG. 7, there is illustrated one form of the ceramic cylinders 64 and the metallic spacers being finally installed against the continuous hoop member 30. The hoop member is heated to a predetermined temperature and the ceramic cylinders 64 and metallic spacers 60 are set into position. A load is applied to push the last ceramic cylinder 64 and metallic spacers 60 into position. The blade track segments 24 are then moved axially into position. In one form of the present invention the predetermined temperature is about 500° F.

As previously mentioned, fingers 46 on the blade track would engage surface 41 on spacers 60 to inhibit the cylinder and spacer assembly forming the expansion control material from buckling inward. The blade tracks 24 are held in place by engagement of flange 42 on wall 33 with recess 44 on the blade track and corresponding structures formed on opposite wall 32 and blade track portion. As will be understood, the combination of metallic and ceramic components in the compression stack placed in the inner cavity 34 permits the expansion control material to be tailored to meet specific thermal expansion characteristics.

A cylindrical shape for the ceramic cylinders 64 is preferred to decrease the average and peak stresses applied on the surface. Still more preferably, the metal spacers would be shaped and coated to decrease the bearing stresses in the parts. The spacers preferably include a curved portion 100 that corresponds to the shape of the outer surface of the ceramic members 64. In one form of the present invention the metallic spacers are formed of MAR-M247 and the ceramic members are formed of silicon nitride. In another form of the present invention the metallic spacers are coated with a high temperature dry film lubricant. However, other materials and coatings are contemplated herein. As shown in FIG. 6, it is contemplated that a slight gap 66 may be created between adjacent spacers 60 and 62. The gap is preferably within a range of about 0.020 inches to about 0.060 inches. It will be understood that should ceramic cylinder 64 deteriorate, collapse, or otherwise fail, gap 66 may close and the system may continue to operate, at a slightly lower effectiveness.

Figure 8:
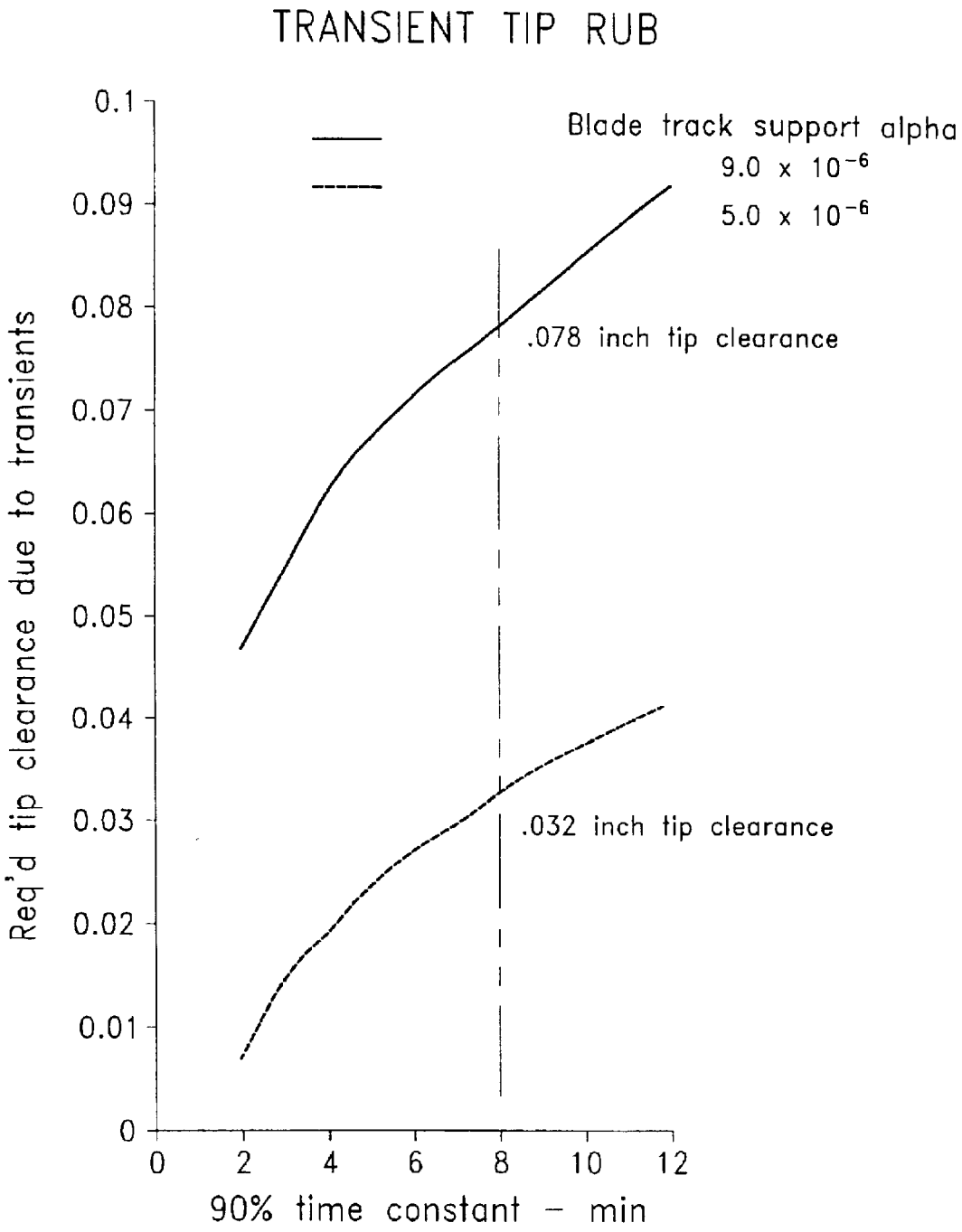
FIG. 8 is a graph showing the reduction in tip clearance by lowering the thermal expansion coefficient of the blade track support assembly.

Referring to FIG. 8, there is illustrated a graph showing advantages that may be achieved with use of the present invention for controlling blade track expansion. Specifically, in the preferred embodiment illustrated and described herein, the effect on one application was to lower the thermal expansion coefficient of the support assembly from $9.0\times10^{-6}$ in/in/deg. F. to $5.0\times10^{-6}$ in/in/deg. F. As shown in FIG. 7, the tip clearance required due to thermal transients can be reduced from 0.078 inches to 0.032 inches (a 60% reduction) for one application such as shown in FIG. 2.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. In reading the claims, it is intended that when words such as "a," "an," "at least one," or "at least a portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A gas turbine engine apparatus, comprising:

a ring member having a centerline, said ring member having a cavity open towards said centerline;

a plurality of circumferentially spaced ceramic members positioned within said cavity;

a plurality of metallic members positioned within said cavity, said plurality of ceramic members and said plurality of metallic members are positioned so that each of said plurality of ceramic members is located between a pair of said plurality of metallic members; and a blade track coupled with said ring member and extending over a portion of said cavity.

2. The support of claim 1, wherein said ring member has a thermal coefficient of expansion greater than a thermal coefficient of expansion of said ceramic members.

3. The apparatus of claim 1, wherein said ring member is in tension and said plurality of ceramic members and said plurality of metallic members are in compression.

4. The apparatus of claim 3, wherein each of said plurality of ceramic members has an outer surface, and wherein each of said plurality of metallic members includes a portion having a shape corresponding to said outer surface, and further wherein said portion abutting said outer surface in a form fitting relationship.

5. The apparatus of claim 1, wherein said plurality of ceramic members are cylindrical, and said plurality of metallic members and said plurality of ceramic members are spaced along the circumference of said ring member.

6. The apparatus of claim 1, wherein each of said plurality of ceramic members is cylindrical;

wherein said plurality of metallic members do not abut one another; and wherein said blade track includes a plurality of blade track segments.

7. A support for a gas turbine engine blade track, comprising:

a ring member having a centerline, said ring member having a cavity open towards said centerline;

a plurality of circumferentially spaced ceramic members positioned within said cavity; and a plurality of metallic members positioned within said cavity, said plurality of ceramic members and said plurality of metallic members are positioned so that each of said plurality of ceramic members is located between a pair of said plurality of metallic members, wherein said ring member is in tension and said plurality of ceramic members and said plurality of metallic members are in compression.

8. The support of claim 7, wherein each of said plurality of ceramic members has an outer surface, and wherein each of said plurality of metallic members includes a portion having a shape corresponding to said outer surface, and further wherein said portion abutting said outer surface in a form fitting relationship.

9. The support of claim 8, wherein each of said plurality of ceramic members is cylindrical.

10. The support of claim 9, wherein said plurality of metallic members do not abut one another.

11. The support of claim 9, wherein said ring member includes a pair of spaced sidewalls defining said cavity, and wherein at least one of said pair of sidewalls includes means for stress relief.

12. A support for a gas turbine engine blade track, comprising:

a ring member having a centerline said ring member having a cavity open towards said centerline;

a plurality of circumferentially spaced ceramic members positioned within said cavity; and a plurality of metallic members positioned within said cavity, said plurality of ceramic members and said plurality of metallic members are positioned so that each of said plurality of ceramic members is located between a pair of said plurality of metallic members, wherein said plurality of ceramic members are cylindrical, and said plurality of metallic members and said plurality of ceramic members are spaced along the circumference of said ring member.

13. A low expansion blade track assembly, comprising:

a continuous hoop member having an inner surface;

a plurality of blade track segments coupled to said hoop member; and expansion control means located within said hoop member for controlling the position of said plurality of blade track segments, said expansion control means including a first surface abutting said inner surface, wherein said expansion control means includes a plurality of ceramic cylinders and a plurality of metallic spacers arranged with each of aid plurality of ceramic cylinders located between a pair of said plurality of metallic spacers.

14. The assembly of claim 13, wherein said expansion control means is loaded in compression and said hoop member is loaded in tension.

15. The assembly of claim 13, wherein each of said blade track segments includes a member extending therefrom and adapted to limit inward movement of said expansion control means.

16. The assembly of claim 13, wherein each of said metallic spacers has a bearing surface corresponding to the shape of an outer surface of said ceramic cylinder, and wherein said outer surface of each ceramic cylinder abutting at least one of said bearing surfaces.

17. A blade track support assembly, comprising:

a continuous metallic ring member symmetrical about a centerline, said ring member having a circumferential channel opening towards said centerline;

a plurality of circumferentially spaced ceramic cylinders extending parallel to said centerline and located within said channel, each of said ceramic cylinders has an outer surface; and a plurality of circumferentially spaced metallic spacers extending parallel to said centerline and located within said channel, each of said plurality of metallic spacers including a pair of bearing surfaces corresponding to said outer surface, each of said plurality of ceramic cylinders located between a pair of said plurality of metallic spacers, and each of said bearing surfaces abutting one of said ceramic cylinders.

18. The assembly of claim 17, wherein said ring member is in tension and said plurality of ceramic cylinders and said plurality of metallic spacers are in compression.

19. The assembly of claim 17, wherein said ceramic cylinders have a thermal coefficient of expansion less than the thermal coefficient of expansion of said metallic spacers and said ring member.

20. The assembly of claim 17, which further includes at least one member coupled with said ring member and extending towards said plurality of spacers and adapted to limit inward buckling of said plurality of spacers.

21. The assembly of claim 17, wherein said plurality of spacers has a first mode wherein they are separated, and a second mode wherein at least a pair of said plurality of spacers abut one another.

* * * * *